US011536268B2

(12) United States Patent
Kubo et al.

(10) Patent No.: US 11,536,268 B2
(45) Date of Patent: Dec. 27, 2022

(54) ELECTRIC PUMP

(71) Applicants: KYB Corporation, Tokyo (JP); NIDEC TOSOK CORPORATION, Zama (JP)

(72) Inventors: Kohei Kubo, Gifu (JP); Tomoyuki Fujita, Gifu (JP); Koichiro Akatsuka, Gifu (JP); Yoshiyuki Maki, Aichi (JP); Koji Higuchi, Kanagawa (JP); Yutaka Hashimoto, Kanagawa (JP)

(73) Assignees: KYB CORPORATION, Tokyo (JP); NIDEC TOSOK CORPORATION, Zama (JP)

( * ) Notice: Subject to any disclaimer, the term of this patent is extended or adjusted under 35 U.S.C. 154(b) by 0 days.

(21) Appl. No.: 17/268,926

(22) PCT Filed: Oct. 29, 2019

(86) PCT No.: PCT/JP2019/042405

§ 371 (c)(1),
(2) Date: Feb. 16, 2021

(87) PCT Pub. No.: WO2020/095768

PCT Pub. Date: May 14, 2020

(65) Prior Publication Data

US 2021/0348620 A1 Nov. 11, 2021

(30) Foreign Application Priority Data

Nov. 9, 2018 (JP) ..... JP2018-211319

(51) Int. Cl.
*F04C 15/00* (2006.01)
*F04D 13/06* (2006.01)
(Continued)

(52) U.S. Cl.
CPC ..... *F04C 15/0073* (2013.01); *F04C 2/344* (2013.01); *F04C 2/3446* (2013.01);
(Continued)

(58) Field of Classification Search
CPC ..... F04C 15/06; F04C 2/3446; F04C 2/344; F04C 15/00; F04C 2240/30;
(Continued)

(56) References Cited

U.S. PATENT DOCUMENTS 4,023,920 A * 5/1977 Bachler ..... F16C 39/02 417/372
4,385,768 A * 5/1983 Swearingen ..... F04D 29/0513 277/412

(Continued)

FOREIGN PATENT DOCUMENTS

JP H0575491 U 10/1993
JP 2011149535 A 8/2011

(Continued)

*Primary Examiner* — Peter J Bertheaud
(74) *Attorney, Agent, or Firm* — Rabin & Berdo, P.C.

(57) ABSTRACT

An electric pump provided with a pump unit configured to discharge working oil by being rotationally driven by an electric motor includes: a drive shaft configured to transmit rotational driving force from the electric motor to a rotor of the pump unit; a rotation-detection shaft provided coaxially with the drive shaft, the rotation-detection shaft being configured to be rotated together with the rotor; and a rotation detector unit configured to detect rotation of the rotation-detection shaft. The rotation-detection shaft has: an engagement portion configured to engage with the rotor; and a detection-target portion facing the rotation detector unit, and an outer diameter of the detection-target portion is set so as to be larger than an outer diameter of the engagement portion.

8 Claims, 2 Drawing Sheets

(51) Int. Cl.

| | |
|---|---|
| ***F04D 29/043*** | (2006.01) |
| ***F04D 29/053*** | (2006.01) |
| ***F04D 27/00*** | (2006.01) |
| ***F04D 27/02*** | (2006.01) |
| ***F04C 15/06*** | (2006.01) |
| ***F04C 2/344*** | (2006.01) |
| ***F04C 28/28*** | (2006.01) |

(52) U.S. Cl.
CPC ..... *F04C 15/00* (2013.01); *F04C 15/06* (2013.01); *F04D 13/06* (2013.01); *F04D 27/001* (2013.01); *F04D 27/0292* (2013.01); *F04D 29/043* (2013.01); *F04D 29/053* (2013.01); *F04C 28/28* (2013.01); *F04C 2240/30* (2013.01); *F04C 2240/60* (2013.01); *F04C 2240/81* (2013.01); *F04C 2270/05* (2013.01); *F04C 2270/052* (2013.01)

(58) Field of Classification Search
CPC ..... F04C 2240/60; F04C 15/0073; F04C 2240/81; F04C 2270/05; F04C 2270/052; F04C 28/28; F04D 27/001; F04D 27/0292; F04D 29/053; F04D 13/06; F04D 29/043
See application file for complete search history.

(56) References Cited

U.S. PATENT DOCUMENTS

| | | | | |
|---|---|---|---|---|
| 4,822,251 | A * | 4/1989 | Amrath | F04C 28/28 417/63 |
| 7,927,079 | B2 * | 4/2011 | Suzuki | F04C 11/008 318/400.11 |
| 10,001,130 | B2 * | 6/2018 | Kozaki | F04D 19/042 |
| 2014/0294625 | A1 * | 10/2014 | Tucker | B60G 17/0195 310/68 B |

FOREIGN PATENT DOCUMENTS

| | | | |
|---|---|---|---|
| JP | 2012061949 | A | 3/2012 |
| JP | 2018080687 | A | 5/2018 |

* cited by examiner

ELECTRIC PUMP

TECHNICAL FIELD

The present invention relates to an electric pump.

BACKGROUND ART

JP2018-80687A discloses an electric pump including an electric motor, a pump unit that discharges working fluid by being rotationally driven, and a shaft that provides a driving force from the electric motor to the pump unit.

SUMMARY OF INVENTION

In order to detect rotation of the pump unit in the electric pump disclosed in JP2018-80687A, it is considered to extend an end portion of the shaft, which provides the driving force from the electric motor to the pump unit, from the pump unit and to detect the rotation of the extended portion by a rotation detector unit. In this case, because the extended portion of the shaft extending from the pump unit is to be inserted into the pump unit at the time of assembly, the extended portion is formed so as to have a relatively small diameter. If the diameter of the extended portion facing the rotation detector unit is small, shaft vibration tends to be caused, and thereby, there is a risk in that a detection accuracy of the rotation detector unit for the rotation of the pump unit is lowered.

An object of the present invention is to improve a detection accuracy of a rotation detector unit for rotation of a pump unit.

According to an aspect of the present invention, an electric pump provided with a pump unit configured to discharge working fluid by being rotationally driven by an electric motor includes: a transmission shaft configured to transmit rotational driving force from the electric motor to a rotating member of the pump unit; a rotation-detection shaft provided coaxially with the transmission shaft, the rotation-detection shaft being configured to be rotated together with the rotating member; and a rotation detector unit configured to detect rotation of the rotation-detection shaft. The rotation-detection shaft has: an engagement portion configured to engage with the rotating member; and a detection-target portion facing the rotation detector unit, and an outer diameter of the detection-target portion is set so as to be larger than an outer diameter of the engagement portion.

DESCRIPTION OF EMBODIMENTS

Embodiments of the present invention will be described below with reference to the drawings.

First Embodiment

Figure 1:
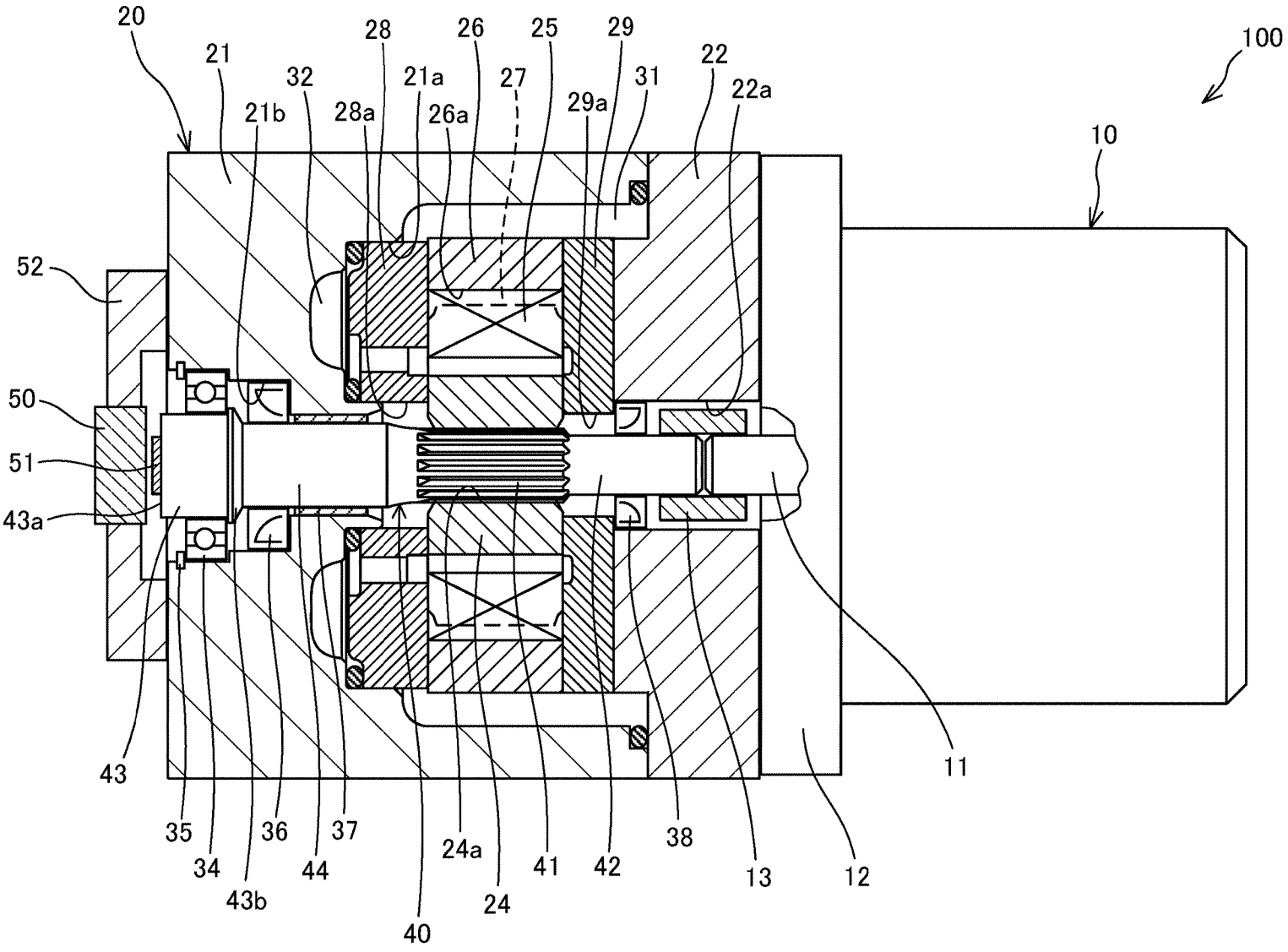
FIG. 1 is a sectional view of an electric pump according to a first embodiment of the present invention.

An electric pump 100 according to a first embodiment of the present invention will be described with reference to FIG. 1. FIG. 1 is a sectional view of the electric pump 100 according to the first embodiment of the present invention.

The electric pump 100 is used as a fluid pressure source that supplies pressurized working fluid to a fluid hydraulic apparatus mounted on a vehicle, for example, a power steering apparatus, a continuously variable transmission, and so forth. The working fluid is working oil, other aqueous alternative fluid, and so forth.

As shown in FIG. 1, the electric pump 100 is provided with an electric motor 10 and a pump unit 20 that discharges the working oil by being rotationally driven by the electric motor 10.

The electric motor 10 is a brushless motor having a drive shaft 11 serving as a transmission shaft that is rotatably supported by a housing via two bearings (not shown), a rotor (not shown) that is fixed to the drive shaft 11, and a stator (not shown) that is fixed to an inner circumference of the housing so as to oppose to the rotor in the radial direction. The electric motor 10 is connected to the pump unit 20 via a flange portion 12 by bolts (not shown). In the above, the electric motor 10 is not limited to the brushless motor, and an electric motor having other configurations may be employed. The electric motor 10 may also be a brushed motor, for example.

The pump unit 20 is a vane pump having a rotor 24 serving as a rotating member to which a rotational driving force from the electric motor 10 is transmitted via the drive shaft 11, a plurality of vanes 25 that are freely slidably received in a plurality of slits formed radially in the rotor 24, and a cam ring 26 that receives the rotor 24 and has a cam face 26*a* formed on an inner circumference thereof. Tip end portions of the vanes 25 are brought into sliding contact with the cam face 26*a* as the rotor 24 is rotated. In the cam ring 26, a plurality of pump chambers 27 are defined by an outer circumferential surface of the rotor 24, the cam face 26*a* of the cam ring 26, and adjacent vanes 25.

The rotor 24 is an annular member having, at its center portion, a through hole 24*a* serving as an engaging hole that is formed so as to penetrate through the rotor 24 in the shaft direction. An inner circumferential surface of the through hole 24*a* is subjected to a spline processing.

The cam ring 26 is an annular member having the substantially oval-shaped cam face 26*a* that is formed on the inner circumferential surface thereof. The cam face 26*a* has two suction regions at which volumes of the pump chambers 27 are expanded along with the rotation of the rotor 24 and two discharge regions at which volumes of the pump chambers 27 are contracted along with the rotation of the rotor 24.

The pump unit 20 further has a pump housing 21 in which an accommodating concave portion 21*a* accommodating the rotor 24, the vanes 25, and the cam ring 26 is provided, a pump cover 22 that closes an opening portion of the pump housing 21, a first side plate 28 that is arranged between the pump housing 21 and first side surfaces of the rotor 24 and the cam ring 26, and a second side plate 29 that is arranged between the pump cover 22 and second side surfaces of the rotor 24 and the cam ring 26.

The first side plate 28 is a disc member that is provided with, at its center portion, a through hole 28*a* formed so as to penetrate through the first side plate 28 in the shaft direction. In addition, the first side plate 28 is formed with two arc-shaped through holes (not shown) as discharge ports. The discharge ports are provided so as to respectively correspond to the discharge regions of the cam ring 26, and the working oil discharged from the pump chambers 27 through the discharge ports is guided to a high-pressure chamber 32, which will be described later.

The second side plate 29 is an annular member that is provided with, at its center portion, a through hole 29*a* formed so as to penetrate through the second side plate 29 in the shaft direction. In addition, two suction ports (not shown) are formed in an outer circumference of the second side plate 29 by being cut out in arc shapes. The suction ports are provided so as to respectively correspond to the suction regions of the cam ring 26, and the working oil is guided to the pump chambers 27 through the suction ports. In the above, the suction ports may be provided not only in the second side plate 29, but also in the first side plate 28. In addition, the suction ports, etc. formed in the second side plate 29 may be formed in the pump cover 22 instead, and thereby, it is possible to omit the second side plate 29.

The pump housing 21 provided with the accommodating concave portion 21*a* is further provided with the high-pressure chamber 32 that is formed on the bottom surface side of the accommodating concave portion 21*a*, a suction pressure chamber 31 formed in an inner circumferential surface of the accommodating concave portion 21*a*, and a through hole 21*b* that is formed so as to penetrate through the pump housing 21 in the shaft direction at the center portion thereof.

The high-pressure chamber 32 is defined by the pump housing 21 and the first side plate 28 and communicates with an external fluid hydraulic apparatus via a discharge passage (not shown) formed in the pump housing 21. Thus, the working oil that has been pressurized in the pump chambers 27 is guided to the fluid hydraulic apparatus via the discharge ports, the high-pressure chamber 32, and the discharge passage.

The suction pressure chamber 31 communicates with the suction ports and also communicates with a tank for storing the working oil via a suction passage (not shown) that is formed in the pump housing 21 or the pump cover 22. Thus, the working oil stored in the tank is guided to the pump chambers 27 via the suction passage, the suction pressure chamber 31, and the suction ports.

In the through hole 21*b*, a bearing 34 that rotatably supports a rotation-detection shaft 40, which will be described later, an oil seal 36 that prevents leakage of the working oil to the outside, and a bush 37 that supports the rotation-detection shaft 40 are held in this order towards the rotor 24. The bearing 34 is a ball bearing, and movement of bearing 34 in the shaft direction is restricted by a retaining ring 35 that is fitted into a groove formed in the through hole 21*b*.

The pump cover 22 is provided with a through hole 22*a* that is formed so as to penetrates through the pump cover 22 in the shaft direction at the center portion thereof. The through hole 22*a* is provided with an oil seal 38 that prevents leakage of the working oil towards the electric motor 10 side.

In a casing, which is formed by the pump housing 21 and the pump cover 22 having the above-described shapes, the rotor 24 is accommodated freely rotatably so as to be sandwiched between the first side plate 28 and the second side plate 29.

The electric pump 100 is further provided with the rotation-detection shaft 40 that is rotated together with the rotor 24 and a rotation detector unit 50 that detects the rotation of the rotation-detection shaft 40.

The rotation-detection shaft 40 is a rod-like member having an engagement portion 41 that engages with the rotor 24, a detection-target portion 43 that faces the rotation detector unit 50, and an extended portion 42 that extends towards the opposite side from the detection-target portion 43 with respect to the engagement portion 41. The rotation-detection shaft 40 is provided coaxially with the drive shaft 11. The rotation-detection shaft 40 is formed such that the outer diameter of the engagement portion 41 is larger than the outer diameter of the extended portion 42, and the outer diameter of the detection-target portion 43 is larger than the outer diameter of the engagement portion 41.

An outer circumferential surface of the engagement portion 41 is subjected to the spline processing, and the rotation-detection shaft 40 is coupled with the through hole 24*a* of the rotor 24 by a spline-coupling via the engagement portion 41.

The extended portion 42 is joined to the drive shaft 11 via a tubular joint member 13. The joint member 13 is a shaft coupling that transmits the rotation of the drive shaft 11 to the rotation-detection shaft 40 and has key grooves (not shown) with which a key member (not shown) provided on an outer circumferential surface of the extended portion 42 and the key member (not shown) provided on an outer circumferential surface of the drive shaft 11 are engaged.

In the above, the joint member 13 may be a shaft coupling having any configuration as long as the rotation of the drive shaft 11 can be transmitted to the rotation-detection shaft 40, and for example, the joint member 13 may be an Oldham's coupling.

In addition, a lip portion (not shown) of the oil seal 38 provided in the pump cover 22 is in sliding contact with the outer circumferential surface of the extended portion 42, and the leakage of the working oil towards the electric motor 10 side through a gap between the extended portion 42 and the pump cover 22 is prevented by the oil seal 38.

The detection-target portion 43 is a portion formed to have a cylinder shape, and is a portion that is provided with a member used to detect a rotation state of the detection-target portion 43 by the rotation detector unit 50 or that is formed to have a shape for detecting the rotation state. An end surface 43*a* facing the rotation detector unit 50 is attached with, for example, a magnet 51 serving as a member for detecting the rotation state. The magnet 51 is a permanent magnet, such as a neodymium magnet and a ferrite magnet, and is fixed to the end surface 43*a* via a holder (not shown). In the above, the magnet 51 may be directly assembled to the end surface 43*a* without providing the holder, or the magnet 51 may be provided by magnetizing the end surface 43*a*.

In addition, an outer circumferential surface of the detection-target portion 43 is provided with a flange portion 43*b* that projects outwards in the radial direction. The flange portion 43*b* is provided for aligning, in the shaft direction, the bearing 34 that is press-fitted to the outer circumferential surface of the detection-target portion 43. In the above, instead of using the flange portion 43*b*, the alignment of the bearing 34 may also be achieved with a retaining ring, etc. that is fitted into a groove formed in the outer circumferential surface of the detection-target portion 43.

The rotation-detection shaft 40 further has an intermediate portion 44 that is formed between the engagement portion 41 and the detection-target portion 43. The lip portion (not shown) of the oil seal 36 and the bush 37 provided in the pump housing 21 comes into sliding contact with an outer circumferential surface of the intermediate portion 44. By providing the oil seal 36, leakage of the working oil through a gap between the intermediate portion 44 and the pump housing 21 towards the rotation detector unit 50 side is prevented. In the above, the outer diameter of the intermediate portion 44 is set so as to be larger than the outer diameter of the engagement portion 41 and smaller than the outer diameter of the detection-target portion 43.

The rotation detector unit 50 has a magnetism detecting sensor (not shown), such as a hole element, etc., that is capable of detecting a change in magnetism of the magnet 51 that is caused along with the rotation of the detection-target portion 43 and a computing unit (not shown) that computes the rotation speed of the rotation-detection shaft 40, in other words, the rotation speed of the rotor 24 on the basis of the detected value by the magnetism detecting sensor. The rotation detector unit 50 is fixed to the pump housing 21 via a bracket 52 such that the magnetism detecting sensor is positioned so as to face the magnet 51 provided on the end surface 43*a* of the detection-target portion 43.

Next, operation of the electric pump 100 having the above-described configuration will be described.

When electric power is supplied from a motor driver (not shown) to the electric motor 10, the drive shaft 11 of the electric motor 10 is rotated according to the supplied electric power. The rotation of the drive shaft 11 is transmitted to the rotation-detection shaft 40 via the joint member 13, and the rotation of the rotation-detection shaft 40 is transmitted to the rotor 24 of the pump unit 20. In other words, the rotational driving force from the electric motor 10 is transmitted to the rotor 24 of the pump unit 20 via the rotation-detection shaft 40 and the drive shaft 11.

As the rotor 24 is rotationally driven as described above, respective pump chambers 27 are expanded/contracted such that the working oil in the tank is sucked into the expanding pump chambers 27 and the working oil is discharged from the contracting pump chambers 27. The working oil that has discharged from the pump chambers 27 to the high-pressure chamber 32 through the discharge ports is then supplied to the external fluid hydraulic apparatus through the discharge passage.

In addition, the rotation speed of the pump unit 20, in other words, the rotation speed of the rotor 24 during the operation of the electric pump 100 is detected by the rotation detector unit 50 that detects the rotation of the rotation-detection shaft 40 rotated together with the rotor 24. By performing a feed back control on electric power supplied to the electric motor 10 such that the rotation speed detected by the rotation detector unit 50 becomes the desired rotation speed, it is possible to accurately control the rotation speed of the electric pump 100 at an arbitrary level.

In the above, for example, if the outer diameter of the detection-target portion 43 facing the rotation detector unit 50 is small, the position of the magnet 51 facing the rotation detector unit 50 is not stabilized due to occurrence of shaft vibration, and, as a result, the rotation detection accuracy for the pump unit 20 by the rotation detector unit 50 is lowered, and it becomes difficult to accurately control the rotation speed of the electric pump 100.

In contrast, in the electric pump 100 having the above-described configuration, by providing the rotation-detection shaft 40 as a separate member from the drive shaft 11, it is possible to make the outer diameter of the detection-target portion 43 of the rotation-detection shaft 40 facing the rotation detector unit 50 larger than the outer diameter of the engagement portion 41 that engages with the rotor 24. As described above, by suppressing the occurrence of the shaft vibration by making the outer diameter of the detection-target portion 43 of the rotation-detection shaft 40 facing the rotation detector unit 50 relatively large, it is possible to improve the rotation detection accuracy for the pump unit 20 by the rotation detector unit 50.

In addition, in the electric pump 100 having the above-described configuration, a portion of the rotation-detection shaft 40 on the detection-target portion 43 side is rotatably supported by the bearing 34 that is held in the pump housing 21. As described above, by supporting the portion of the rotation-detection shaft 40 towards the end portion, that is the portion on the detection-target portion 43 side, by the pump housing 21 via the bearing 34, the occurrence of the shaft vibration is suppressed on the detection-target portion 43, and thereby, it is possible to further improve the rotation detection accuracy for the pump unit 20 by the rotation detector unit 50. In addition, because the detection-target portion 43 of the rotation-detection shaft 40 is supported by the pump housing 21 to which the rotation detector unit 50 is assembled via the bracket 52, it is possible to easily perform alignment of the rotation detector unit 50 relative to the detection-target portion 43 with high accuracy.

In addition, in the electric pump 100 having the above-described configuration, the rotation-detection shaft 40 is joined with the drive shaft 11 at the extended portion 42 that extends towards the opposite side from the detection-target portion 43 with respect to the engagement portion 41. As described above, because the drive shaft 11 is not directly coupled with the rotor 24, there is no need to perform a special processing, such as spline processing, on the drive shaft 11. Therefore, a common electric motor can be employed as the electric motor 10, and, as a result, it is possible to reduce manufacturing costs of the electric pump 100.

According to the first embodiment described above, the advantages described below are afforded.

In the electric pump 100, by providing the rotation-detection shaft 40 as a separate member from the drive shaft 11, it is possible to make the outer diameter of the detection-target portion 43 of the rotation-detection shaft 40 facing the rotation detector unit 50 larger than the outer diameter of the engagement portion 41 that engages with the rotor 24. As described above, by suppressing the occurrence of the shaft vibration on the detection-target portion 43 by making the outer diameter of the detection-target portion 43 of the rotation-detection shaft 40 facing the rotation detector unit 50 relatively large, it is possible to improve the rotation detection accuracy for the pump unit 20 by the rotation detector unit 50.

Second Embodiment

Figure 2:
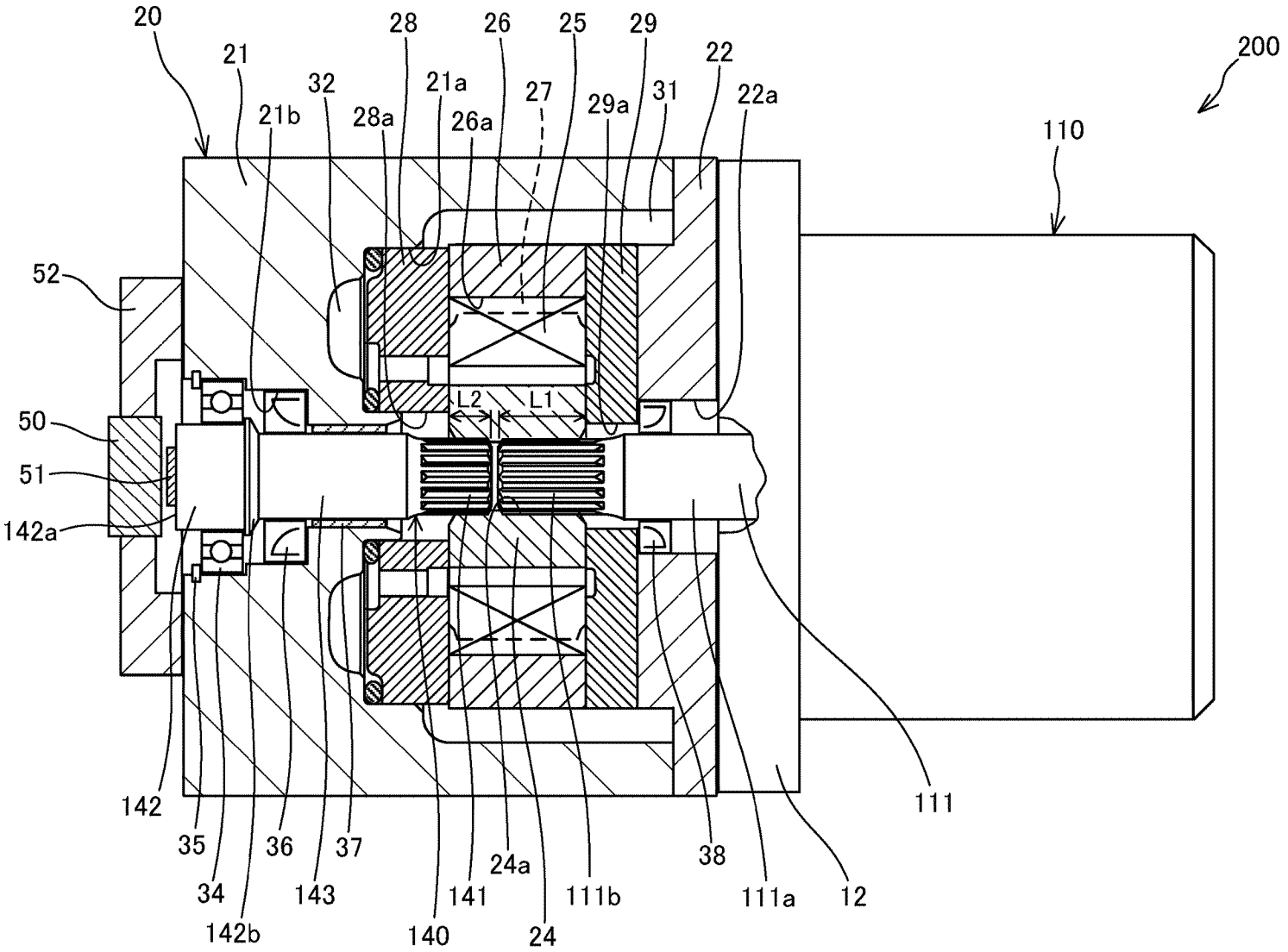
FIG. 2 is a sectional view of an electric pump according to a second embodiment of the present invention.

Next, an electric pump 200 according to a second embodiment of the present invention will be described with reference to FIG. 2. In the following, differences from the above-described first embodiment will be mainly described, and components that have the same functions as those in the electric pump 100 according to the above-described first embodiment are assigned the same reference numerals in the figures and descriptions thereof will be omitted. FIG. 2 is a sectional view of the electric pump 200 according to the second embodiment of the present invention.

The basic configuration of the electric pump 200 is similar to that of the electric pump 100 according to the above-described first embodiment. Whereas the drive shaft 11 is joined to the rotation-detection shaft 40 via the joint member 13 in the electric pump 100 according to the above-described first embodiment, the electric pump 200 mainly differs in that, a drive shaft 111 and a rotation-detection shaft 140 are linked via the rotor 24.

The drive shaft 111 of an electric motor 110 has an insertion portion 111*a* that is inserted into the pump unit 20 and an engagement portion 111*b* that is provided on a tip end of the insertion portion 111*a* and that engages with the rotor 24.

Because the insertion portion 111*a* is inserted into the through hole 22*a* in the pump cover 22, the lip portion (not shown) of the oil seal 38 provided in the pump cover 22 comes into sliding contact with an outer circumferential surface of the insertion portion 111*a*. By providing the oil seal 38, leakage of the working oil through a gap between the insertion portion 111*a* and the pump cover 22 towards the electric motor 110 side is prevented.

In addition, an outer circumferential surface of the engagement portion 111*b* is subjected to the spline processing, and the drive shaft 111 is coupled with the through hole 24*a* of the rotor 24 by the spline-coupling via the engagement portion 111*b*.

The rotation-detection shaft 140 is the rod-like member having an engagement portion 141 that engages with the rotor 24, a detection-target portion 142 that faces the rotation detector unit 50, and an intermediate portion 143 that is provided between the engagement portion 141 and the detection-target portion 142. The rotation-detection shaft 140 is provided coaxially with the drive shaft 111. The rotation-detection shaft 140 is formed such that the outer diameter of the intermediate portion 143 is larger than the outer diameter of the engagement portion 141, and the outer diameter of the detection-target portion 142 is larger than the outer diameter of the intermediate portion 143.

An outer circumferential surface of the engagement portion 141 is subjected to the spline processing, and the rotation-detection shaft 140 is coupled with the through hole 24*a* of the rotor 24 by a spline-coupling via the engagement portion 141.

The detection-target portion 142 has an end surface 142*a* facing the rotation detector unit 50, and similarly to the above-described first embodiment, the magnet 51 is fixed to the end surface 142*a*. In addition, similarly to the above-described first embodiment, an outer circumferential surface of the detection-target portion 142 is provided with a flange portion 142*b* that projects outwards in the radial direction for aligning the bearing 34.

The lip portion (not shown) of the oil seal 36 and the bush 37 provided in the pump housing 21 come into sliding contact with an outer circumferential surface of the intermediate portion 143. By providing the oil seal 36, leakage of the working oil through a gap between the intermediate portion 143 and the pump housing 21 towards the rotation detector unit 50 side is prevented.

Next, an operation of the electric pump 200 having the above-described configuration will be described.

When the electric power is supplied from the motor driver (not shown) to the electric motor 110, the drive shaft 111 of the electric motor 110 is rotated according to the supplied electric power. The rotation of the drive shaft 111 is directly transmitted to the rotor 24 of the pump unit 20. In other words, the rotational driving force from the electric motor 110 is directly transmitted to the rotor 24 of the pump unit 20 via the drive shaft 111.

As the rotor 24 is rotationally driven as described above, respective pump chambers 27 are expanded/contracted such that the working oil in the tank is sucked into the expanding pump chambers 27 and the working oil is discharged from the contracting pump chambers 27. The working oil that has discharged from the pump chambers 27 to the high-pressure chamber 32 through the discharge ports is then supplied to the external fluid hydraulic apparatus through the discharge passage.

On the other hand, when the electric pump 200 is operated, the rotation-detection shaft 140 is rotationally driven by the rotor 24 that is rotationally driven by the drive shaft 111. Thus, the rotation speed of the pump unit 20, in other words, the rotation speed of the rotor 24 during the operation of the electric pump 200 is detected by the rotation detector unit 50 that detects the rotation of the rotation-detection shaft 140 rotationally driven by the rotor 24.

As described above, in the electric pump 200 having the above-described configuration, although the drive shaft 111 needs to transmit the rotational driving force from the electric motor 110 to the rotor 24, the rotation-detection shaft 140 only needs to be rotated together with the rotor 24 and does not need to transmit the rotational driving force. Therefore, a first insertion length L1, which is an insertion length of the drive shaft 111 inserted into the through hole 24*a* of the rotor 24, is set so as to be longer than a second insertion length L2, which is the insertion length of the rotation-detection shaft 140 inserted into the through hole 24*a*. As described above, because the first insertion length L1 is longer than the second insertion length L2 and the contact area between the rotor 24 and the engagement portion 111*b* is ensured, it is possible to reliably transmit the rotational driving force from the electric motor 110 to the rotor 24 via the drive shaft 111.

In addition, for a similar reason, the size of a clearance between the through hole 24*a* and the engagement portion 111*b* is set so as to be smaller than the clearance between the through hole 24*a* and the engagement portion 141. As described above, by fitting the drive shaft 111 towards the rotor 24 as close as possible so as not to form a gap therebetween, it is possible to efficiently transmit the rotational driving force from the electric motor 110 to the pump unit 20, and at the same time, it is possible to reduce the processing cost of the rotation-detection shaft 140 by lowering the processing accuracy of the engagement portion 141 of the rotation-detection shaft 140.

In addition, also in the electric pump 200 having the above-described configuration, similarly to the above-described first embodiment, by providing the rotation-detection shaft 140 as a separate member from the drive shaft 111, it is possible to make the outer diameter of the detection-target portion 142 of the rotation-detection shaft 140 facing the rotation detector unit 50 larger than the outer diameter of the engagement portion 141 that engages with the rotor 24. As described above, by suppressing the occurrence of the shaft vibration by making the outer diameter of the detection-target portion 142 of the rotation-detection shaft 140 facing the rotation detector unit 50 relatively large, it is possible to improve the rotation detection accuracy for the pump unit 20 by the rotation detector unit 50.

In addition, also in the electric pump 200 having the above-described configuration, similarly to the above-described first embodiment, a portion of the rotation-detection shaft 140 on the detection-target portion 142 side is rotatably supported by the bearing 34 that is held in the pump housing 21. As described above, by supporting the portion of the rotation-detection shaft 140 towards the end portion, that is the portion on the detection-target portion 142 side, by the pump housing 21 via the bearing 34, the occurrence of the shaft vibration is suppressed on the detection-target portion 142, and thereby, it is possible to further improve the rotation detection accuracy for the pump unit 20 by the rotation detector unit 50. In addition, because the detection-target portion 142 of the rotation-detection shaft 140 is supported by the pump housing 21 to which the rotation detector unit 50 is assembled via the bracket 52, it is possible to easily perform alignment of the rotation detector unit 50 relative to the detection-target portion 142 with high accuracy.

In addition, in the electric pump 200 having the above-described configuration, because the drive shaft 111 and the rotation-detection shaft 140 are linked via the rotor 24, the joint member 13 that is used in the electric pump 100 according to the above-described first embodiment is no longer required. As described above, because the joint member 13 is not required, a length of the electric pump 200 in the shaft direction can be shortened, and thereby, it is possible to make the electric pump 200 more compact. In addition, because the joint member 13 is not required, the number of parts is reduced, and as a result, it is possible to reduce the manufacturing costs of the electric pump 200.

According to the second embodiment described above, the advantages described below are afforded.

In the electric pump 200, by providing the rotation-detection shaft 140 as a separate member from the drive shaft 111, it is possible to make the outer diameter of the detection-target portion 142 of the rotation-detection shaft 140 facing the rotation detector unit 50 larger than the outer diameter of the engagement portion 141 that engages with the rotor 24. As described above, by suppressing the occurrence of the shaft vibration on the detection-target portion 142 by making the outer diameter of the detection-target portion 142 of the rotation-detection shaft 140 facing the rotation detector unit 50 relatively large, it is possible to improve the rotation detection accuracy for the pump unit 20 by the rotation detector unit 50.

Next, modifications of each of the embodiments described above will be explained.

In each of the embodiments described above, in order to detect the rotation of the detection-target portion 43, 142, the rotation detector unit 50 has the magnetism detecting sensor, such as the hole element, etc., that is capable of detecting the change in the magnetism of the magnet 51. A method for detecting the rotation is not limited thereto. Any method may be employed as long as the rotation of the detection-target portion 43, 142 can be detected. For example, it may be possible to employ a method using an optical switch, such as a photo interrupter, etc., that detects passage or reflection of light or a method using an electromagnetic pickup that detects an induced electromotive force generated by a gear, etc. passing thereby. In this case, the detection-target portion 43, 142 is processed so as to have a shape suitable for the method for detecting the rotation.

In addition, in each of the embodiments described above, the rotation detector unit 50 is arranged so as to face the end surface 43*a*, 142*a* of the detection-target portion 43, 142. The arrangement of the rotation detector unit 50 is not limited thereto, and the rotation detector unit 50 may be arranged so as to face a side surface of the detection-target portion 43, 142. In this case, the magnet 51, etc. that is provided for the detection of the rotation of the detection-target portion 43, 142 is arranged on the side surface of the detection-target portion 43, 142.

In addition, in each of the embodiments described above, the pump unit 20 is the vane pump. The pump unit 20 is not limited to the vane pump, and a pump of any type may be used as long as the working fluid is discharged as the rotating member is rotationally driven. For example, the pump unit 20 may be a gear pump or a piston pump, or the pump unit 20 may be the vane pump that is capable of changing discharge capacity or a swash plate type piston pump.

In addition, in each of the embodiments described above, the drive shaft 11, 111 serving as the transmission shaft is a so-called motor shaft to which the rotor is assembled. The transmission shaft is not limited to the motor shaft, and the transmission shaft may be a shaft that transmits the rotational driving force from the motor shaft via a gear, etc.

In addition, in each of the embodiments described above, the bearing 34 is fitted to the outer circumferential surface of the detection-target portion 43, 142. Instead of this configuration, the bearing 34 may be fitted to the outer circumferential surface of the intermediate portion 143.

In addition, in each of the embodiments described above, among the pump housing 21 and the pump cover 22, the pump cover 22 is arranged on the side of the electric motor 10, 110. Instead of this configuration, the pump housing 21 may be arranged on the side of the electric motor 10, 110. In this case, the bearing 34 is held by the pump cover 22.

In addition, in the above-described first embodiment, the rotation-detection shaft 40 is spline-coupled to the rotor 24, and in the above-described second embodiment, the drive shaft 111 and the rotation-detection shaft 140 are spline-coupled to the rotor 24. Instead of this configuration, it may be possible to employ a configuration in which each shaft is engaged with a key groove formed in the rotor 24 via the key member or a configuration in which each shaft is press-fitted to a through hole formed in the rotor 24. In addition, in the above-described the second embodiment, it may be possible to employ a configuration in which the drive shaft 111 and the rotation-detection shaft 140 are linked by an Oldham's mechanism that is built in the rotor 24.

Configurations, operations, and effects of the embodiment according to the present invention will be collectively described below.

The electric pump 100, 200 provided with the pump unit 20 configured to discharge the working oil by being rotationally driven by the electric motor 10, 110 comprises: the drive shaft 11, 111 configured to transmit the rotational driving force from the electric motor 10, 110 to the rotor 24 of the pump unit 20; the rotation-detection shaft 40, 140 provided coaxially with the drive shaft 11, 111, the rotation-detection shaft 40, 140 being configured to be rotated together with the rotor 24; and the rotation detector unit 50 configured to detect the rotation of the rotation-detection shaft 40, 140, wherein the rotation-detection shaft 40, 140 has: the engagement portion 41, 141 configured to engage with the rotor 24; and the detection-target portion 43, 142 facing the rotation detector unit 50, and the outer diameter of the detection-target portion 43, 142 is set so as to be larger than the outer diameter of the engagement portion 41, 141.

In this configuration, by providing the rotation-detection shaft 40, 140 as a separate member from the drive shaft 11, 111, it is possible to make the outer diameter of the detection-target portion 43, 142 of the rotation-detection shaft 40, 140 facing the rotation detector unit 50 larger than the outer diameter of the engagement portion 41, 141 that engages with the rotor 24. As described above, by suppressing the occurrence of the shaft vibration on the detection-target portion 43, 142 by making the outer diameter of the detection-target portion 43, 142 of the rotation-detection shaft 40, 140 facing the rotation detector unit 50 relatively large, it is possible to improve the rotation detection accuracy for the pump unit 20 by the rotation detector unit 50.

In addition, the pump unit 20 has: the casing formed of the pump housing 21 and the pump cover 22 so as to freely rotatably accommodate the rotor 24; and the bearing 34 held in the pump housing 21 that forms the casing, and the rotation-detection shaft 40, 140 is rotatably supported by the bearing 34 on the side of the detection-target portion 43, 142.

In this configuration, the portion of the rotation-detection shaft 40, 140 on the detection-target portion 43, 142 side is rotatably supported by the bearing 34 that is held in the pump housing 21. As described above, by supporting the portion of the rotation-detection shaft 40, 140 towards the end portion, that is the portion on the detection-target portion 43, 142 side, by the pump housing 21 via the bearing 34, the occurrence of the shaft vibration on the detection-target portion 43, 142 is suppressed. As a result, it is possible to further improve the rotation detection accuracy for the pump unit 20 by the rotation detector unit 50.

In addition, the rotation-detection shaft 40 further has the extended portion 42 extending towards the opposite side from the detection-target portion 43 with respect to the engagement portion 41, and the rotation-detection shaft 40 is joined with the drive shaft 11 at the extended portion 42.

In this configuration, the rotation-detection shaft 40 is joined with the drive shaft 11 at the extended portion 42 that extends towards the opposite side from the detection-target portion 43 with respect to the engagement portion 41. As described above, because the drive shaft 11 is not directly coupled with the rotor 24, there is no need to perform a special processing, such as the spline processing, on the drive shaft 11. Therefore, a common electric motor can be employed as the electric motor 10, and, as a result, it is possible to reduce manufacturing costs of the electric pump 100.

In addition, the rotor 24 has the through hole 24*a* configured such that the rotation-detection shaft 140 engages with the through hole 24*a* from the first end side and the drive shaft 111 engages with the through hole 24*a* from the second end side, and the rotation-detection shaft 140 is linked with the drive shaft 111 via the rotor 24.

In this configuration, the drive shaft 111 and the rotation-detection shaft 140 are linked via the rotor 24. Therefore, there is no need to separately provide a joint member such as the Oldham's coupling, etc. for linking the drive shaft 111 and the rotation-detection shaft 140. As described above, because the joint member is not required, the length of the electric pump 200 in the shaft direction can be shortened, and as a result, it is possible to make the electric pump 200 more compact. In addition, because the joint member is not required, the number of parts is reduced, and as a result, it is possible to reduce the manufacturing costs of the electric pump 200.

In addition, the first insertion length L1 that is the insertion length of the drive shaft 111 inserted into the through hole 24*a* is set so as to be longer than the second insertion length L2 that is the insertion length of the rotation-detection shaft 140 inserted into the through hole 24*a*.

In this configuration, the first insertion length L1 that is the insertion length of the drive shaft 111 inserted into the through hole 24*a* of the rotor 24 is set so as to be longer than the second insertion length L2 that is the insertion length of the rotation-detection shaft 140 inserted into the through hole 24*a*. As described above, by making the first insertion length L1 longer than the second insertion length L2 and by ensuring the contact area between the rotor 24 and the engagement portion 111*b*, it is possible to efficiently transmit the rotational driving force from the electric motor 110 to the rotor 24 via the drive shaft 111.

In addition, the size of the clearance between the through hole 24*a* and the drive shaft 111 is set so as to be smaller than the clearance between the through hole 24*a* and the rotation-detection shaft 140.

In this configuration, the size of the clearance between the through hole 24*a* and the engagement portion 111*b* of the drive shaft 111 is set so as to be smaller than the clearance between the through hole 24*a* and the engagement portion 141 of the rotation-detection shaft 140. As described above, by fitting the drive shaft 111 towards the rotor 24 as close as possible so as not to form a gap therebetween, it is possible to efficiently transmit the rotational driving force from the electric motor 110 to the pump unit 20, and by lowering the processing accuracy of the engagement portion 141 of the rotation-detection shaft 140, it is possible to reduce the processing cost of the rotation-detection shaft 140.

The embodiments of the present invention have been described above, but the above-mentioned embodiments are merely parts of examples of application examples of the present invention, and there is no intention to limit the technical scope of the present invention to the specific configuration of the above-mentioned embodiment.

The present application claims a priority based on Japanese Patent Application No. 2018-211319 filed on Nov. 9, 2018 in the Japan Patent Office, the entire contents of which are incorporated herein by reference.

The invention claimed is:

1. An electric pump provided with a pump unit configured to discharge working fluid by being rotationally driven by an electric motor, the electric pump comprising:

the pump unit including a rotating member having an engaging hole;

a transmission shaft configured to transmit rotational driving force from the electric motor to the rotating member of the pump unit;

a rotation-detection shaft provided coaxially with the transmission shaft, the rotation-detection shaft being configured to rotate together with the rotating member; and a rotation detector unit configured to detect rotation of the rotation-detection shaft, wherein the rotation-detection shaft has: an engagement portion configured to engage with the rotating member; and a detection-target portion facing the rotation detector unit, an outer diameter of the detection-target portion is set so as to be larger than an outer diameter of the engagement portion, and the rotation-detection shaft engages with the engaging hole from a first end side of the rotating member and the transmission shaft engages with the engaging hole from a second end side of the rotating member, so that the rotation-detection shaft is connected to the transmission shaft via the rotating member.

2. The electric pump according to claim 1, wherein the pump unit has: a housing configured to freely rotatably accommodate the rotating member; and a bearing held in the housing, and the rotation-detection shaft is rotatably supported by the bearing on a side of the detection-target portion.

3. The electric pump according to claim 1, wherein an insertion length of the transmission shaft inserted into the engaging hole is set so as to be longer than an insertion length of the rotation-detection shaft inserted into the engaging hole.

4. The electric pump according to claim 2, wherein an insertion length of the transmission shaft inserted into the engaging hole is set so as to be longer than an insertion length of the rotation-detection shaft inserted into the engaging hole.

5. The electric pump according to claim 1, wherein a size of a clearance between the engaging hole and the transmission shaft is set so as to be smaller than a clearance between the engaging hole and the rotation-detection shaft.

6. The electric pump according to claim 2, wherein a size of a clearance between the engaging hole and the transmission shaft is set so as to be smaller than a clearance between the engaging hole and the rotation-detection shaft.

7. The electric pump according to claim 3, wherein a size of a clearance between the engaging hole and the transmission shaft is set so as to be smaller than a clearance between the engaging hole and the rotation-detection shaft.

8. The electric pump according to claim 4, wherein a size of a clearance between the engaging hole and the transmission shaft is set so as to be smaller than a clearance between the engaging hole and the rotation-detection shaft.

* * * * *